US006520387B2

(12) United States Patent
Soehnlen et al.

(10) Patent No.: US 6,520,387 B2
(45) Date of Patent: Feb. 18, 2003

(54) VENT AND POUR CAP

(75) Inventors: Daniel P. Soehnlen, Canton, OH (US); Gregory M. Soehnlen, North Canton, OH (US)

(73) Assignee: Creative Edge Design Group Ltd., Canton, OH (US)

( * ) Notice: Subject to any disclaimer, the term of this patent is extended or adjusted under 35 U.S.C. 154(b) by 0 days.

(21) Appl. No.: 09/875,580

(22) Filed: Jun. 6, 2001

(65) Prior Publication Data

US 2002/0003154 A1 Jan. 10, 2002

Related U.S. Application Data

(60) Provisional application No. 60/210,088, filed on Jun. 7, 2000.

(51) Int. Cl.[7] ..... B65D 47/00

(52) U.S. Cl. ..... 222/552; 222/546; 222/548; 222/482; 220/787; 220/366.1

(58) Field of Search ..... 222/552, 554, 222/546, 548, 549, 551, 482, 484; 215/309, 356, 321, 44; 220/784, 785, 787, 789, 366.1, 601, 288, 780

(56) References Cited

U.S. PATENT DOCUMENTS

| | | | | | |
|---|---|---|---|---|---|
| 373,849 | A | * | 11/1887 | Pomeroy | 215/309 |
| 782,104 | A | * | 2/1905 | Brunner | 222/421 |
| 1,132,620 | A | * | 3/1915 | Sabine | 222/484 |
| 1,273,919 | A | * | 7/1918 | Peed | 222/421 |
| 1,436,645 | A | * | 11/1922 | Brown | 222/478 |
| 1,436,708 | A | * | 11/1922 | Goebel | 222/478 |
| 1,777,826 | A | * | 10/1930 | Cone | 215/309 |
| 1,949,058 | A | * | 2/1934 | Leguillon | 215/74 |
| 2,380,871 | A | * | 7/1945 | Robinson | 222/482 |
| 2,545,350 | A | * | 3/1951 | Fuld | 222/484 |
| 2,549,225 | A | * | 4/1951 | Moy | 215/47 |
| 2,598,403 | A | * | 5/1952 | Macey | 215/79 |
| 3,067,916 | A | * | 12/1962 | Lerner | 222/519 |
| 3,259,935 | A | * | 7/1966 | Miller | 15/571 |
| 3,376,991 | A | * | 4/1968 | Deaver | 215/9 |
| 3,785,539 | A | * | 1/1974 | Wetterek | 222/552 |
| 3,809,275 | A | * | 5/1974 | Ek | 215/13 R |
| 3,941,268 | A | * | 3/1976 | Owens et al. | 215/216 |
| 3,955,712 | A | * | 5/1976 | Santore | 222/80 |
| 4,228,910 | A | * | 10/1980 | Barre | 215/364 |
| 4,625,899 | A | * | 12/1986 | Stull | 222/521 |
| 4,655,355 | A | * | 4/1987 | Turoff et al. | 215/52 |
| 5,680,954 | A | * | 10/1997 | Arnold et al. | 220/300 |
| 5,749,491 | A | * | 5/1998 | Wylder et al. | 220/719 |
| 6,062,441 | A | * | 5/2000 | Mengeu et al. | 222/521 |

* cited by examiner

*Primary Examiner*—Henry C. Yuen
*Assistant Examiner*—F. Nicolas
(74) *Attorney, Agent, or Firm*—Fay, Sharpe, Fagan, Minnich & McKee, LLP

(57) ABSTRACT

A cap assembly cooperates with a container to form a vent portion and a pour portion when a cap is oriented in an open position relative to the container. The cap is dimensioned to seal the container opening in a closed position. The cap and opening are oblong, preferably oval in configuration, and have cooperating thread assemblies that permit the cap to be selectively rotated between the open and closed positions. The cap preferably has a threaded shank that is engaged along a portion of its periphery by central threaded portions disposed on opposite sides of the generally oval container opening.

20 Claims, 4 Drawing Sheets

VENT AND POUR CAP

CROSS-REFERENCE TO RELATED APPLICATION

This application claims the benefit of provisional application Serial No. 60/210,088, filed Jun. 7, 2000.

BACKGROUND OF THE INVENTION

1. Field of the Invention

This application relates to lids or caps for fluid dispensing containers, and more particularly to lids or caps used with containers for comestible products, such as milk, juices, and the like.

2. Discussion of the Art

Milk containers traditionally include a cylindrical opening in a neck region of the container that is externally threaded and adapted to receive an internally threaded closure cap. The plastic cap is rotated or unscrewed to remove the cap from the container and allow the contents of the container to be poured through the cylindrical opening. The cap is then screwed or rotated back into place to close the container opening until used again. The opening is on the order of approximately two inches in diameter.

Fluid containers presently on the market use a traditional circular cap received over a circular opening in the container. The cap and container typically are helically threaded for easy twist on and twist off action of the cap to open and close the container. Moreover, the cap is usually dimensioned to fit over the container opening so that, in conjunction with the circular shape, the cap cannot be inadvertently inserted into the container.

Although sufficient to dispense the container contents, the opening also must serve to allow air to enter the container. Consumers often experience a "glugging" action where air to the interior of the container is occasionally blocked as the fluid contents are poured. This results in a negative pressure in the container interior that collapses the container sidewall during dispensing and/or results in an uneven pouring rate of the fluid from the container. This can lead to instability or spilling during the pouring process.

As described in commonly owned U.S. Pat. No. 6,068,161, a recent development is a container that is uniquely shaped for a number of reasons. Among many attributes of the novel container is a rock-and-pour feature in which a non-round opening is disposed opposite the integrally molded container handle in conjunction with a rounded or curved portion along the bottom of the container beneath the spout allowing the container to be tilted and the contents to be poured therefrom. This facilitates use by children and adults who may be physically challenged and unable to lift the filled container from the counter top or table top and pour its contents into a glass or bowl.

To facilitate the rock-and-pour feature, a non-round opening is desired since it provides an enlarged dispensing opening that provides for an even flow of the container contents and likewise allows the free flow of air into the container to avert the glugging action. The conventional closure cap is not, however, conducive to these goals.

The conventional cap for milk containers is also completely removable from the container. Thus, it is occasionally misplaced or inadvertently thrown away since it can be completely removed from the container. Maintaining the cap on the container during the pouring process adds further constraints and challenges to providing a container that meets all of the needs for improvements in this area.

SUMMARY OF THE INVENTION

The present invention provides a unique vent-and-pour cap configuration that overcomes a number of the problems and deficiencies identified above and others.

According to an exemplary embodiment of the invention, the cap is externally threaded and cooperates with a neck region of the container opening.

The new cap has a generally oval configuration that mates with the oval opening in the container to increase the venting, or air introduction, during pouring. This eliminates glugging associated with pouring the contents from the container.

The cap and opening in the container are also designed so the consumer need not remove the cap from the container, but merely needs to alter the orientation of the cap between pour and closed positions. For example, the consumer pulls upwardly on the cap and rotates the cap one-quarter turn to provide vent and pour openings disposed on opposite sides of the cap. The pour opening allows the milk or juice to be freely poured over an external lip of the container opening. The vent opening, on the other hand, provides an enlarged air vent to eliminate the glugging problem.

The cap is also configured for ease of assembly during automated production allowing the cap to be snapped on and create a seal that prevents leaking during shipment.

A primary advantage of the present invention resides in an improved cap for a fluid container.

Another advantage of the invention resides in the ability to retain the cap with the container in both the closed and open positions.

Yet another advantage of the invention resides in the improved pourability of the container.

Still another advantage relates to the ease with which the assembly is manufactured and assembled during production.

Still other features and advantages of the invention will become apparent to those skilled in the art upon reading and understanding the following detailed description.

DETAILED DESCRIPTION OF THE INVENTION

Figure 1:
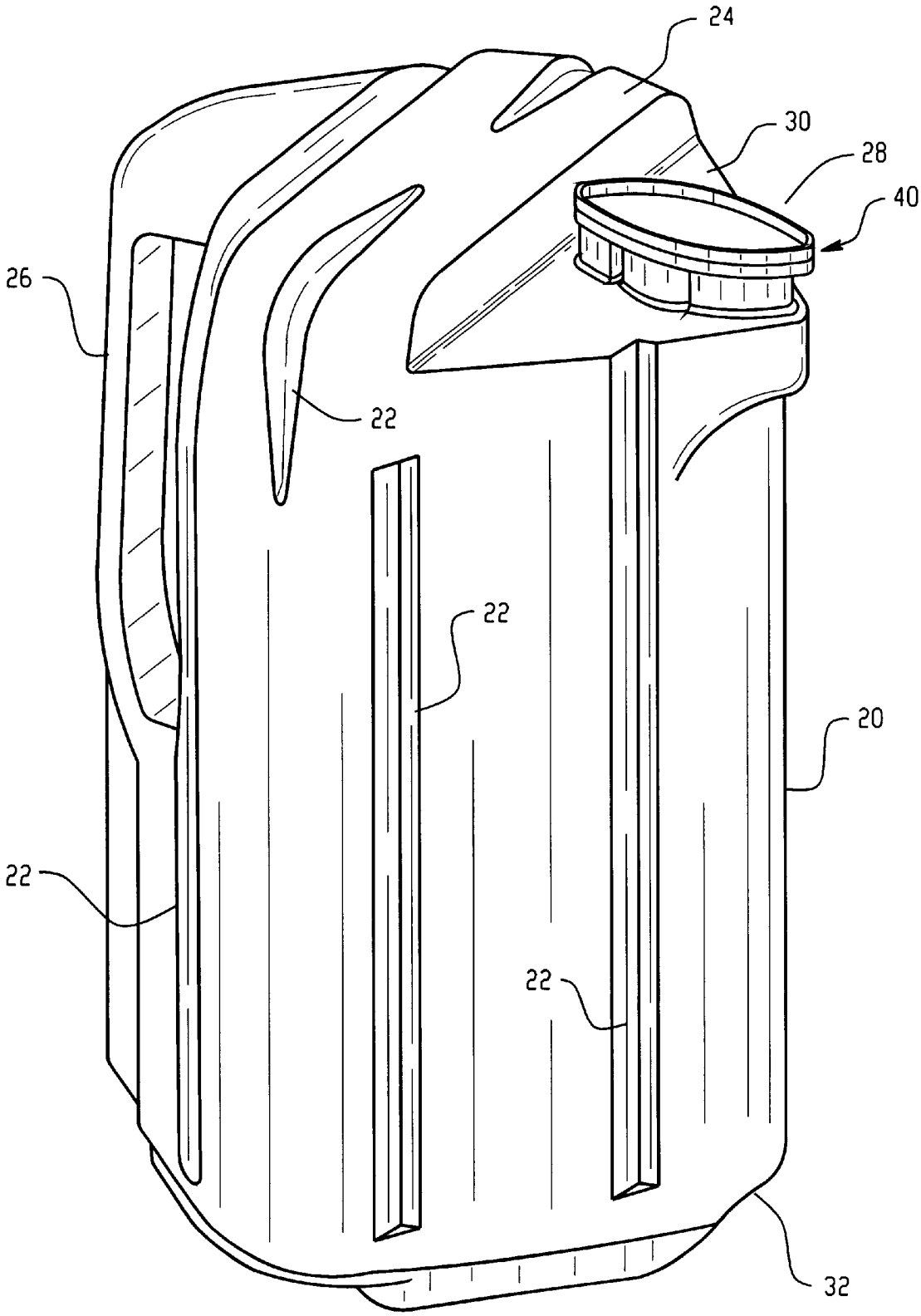
FIG. 1 is a perspective view of a container incorporating the new cap.

An exemplary embodiment of the invention is illustrated in the drawings. Particularly, FIG. 1 illustrates a fluid container 20, certain details of which are more particularly shown and described in commonly owned U.S. Pat. No. 6,068,161, which is incorporated herein by reference. Although more detail is provided in the noted patent, the '161 patent describes a container of the type shown in FIG. 1 that has longitudinal reinforcing members or flutes 22 provided in the container for increased rigidity and strength. A generally planar upper surface 24 works in conjunction with the flutes to allow the containers to be stacked one on top of the other in a convenient fashion. A handle 26 is integrally molded into the container and is disposed opposite from a container opening 28. Preferably, the container opening is provided in a recessed ledge or neck region 30 at an upper end of the container. A rounded rock-and-pour surface 32 is provided at a lower end of the container beneath the spout or opening to allow a user of limited physical capability to simply tilt the container forward along the curved surface 32 and easily pour the contents from the opening 28. In FIG. 1 a cap assembly 40 of a unique configuration in accordance with the present invention is shown in its closed position on the container.

Figure 2:
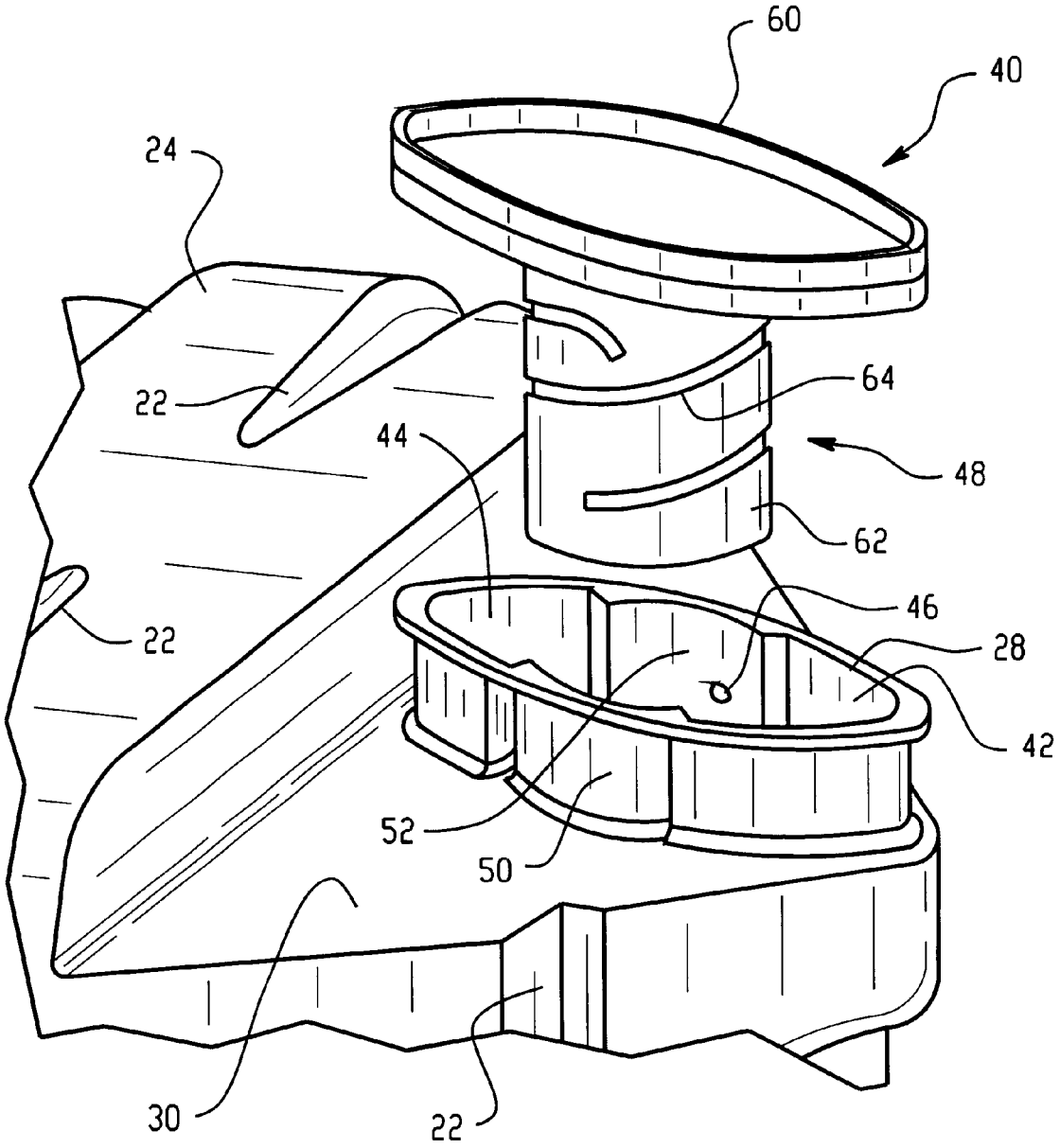
FIG. 2 is an enlarged perspective view of the cap prior to assembly with the container opening.
Figure 3:
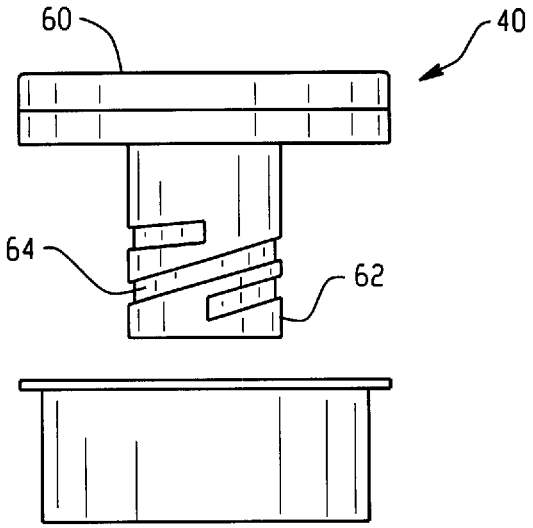
FIG. 3 is an elevational view of a disassembled cap assembly.
Figure 4:
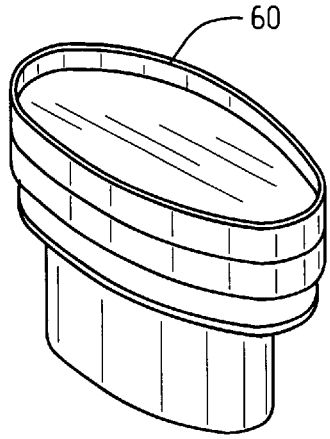
FIG. 4 is a perspective view of an assembled cap.
Figure 5:
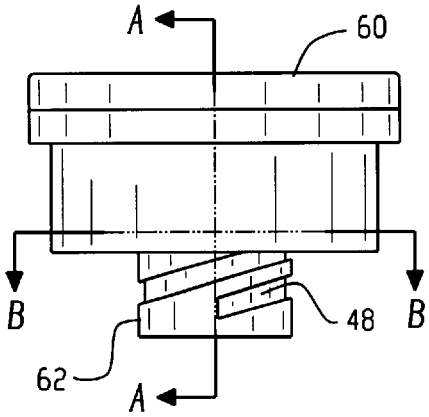
FIG. 5 is an elevational view of the assembled cap of FIG. 4.
Figure 6:
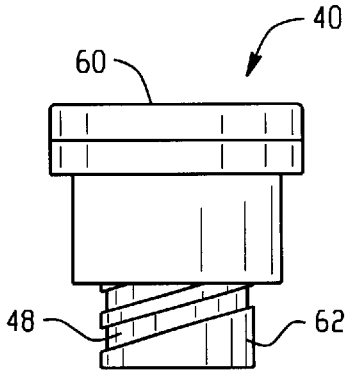
FIG. 6 is an elevational view taken generally from the righthand side of FIG. 5.
Figure 7:
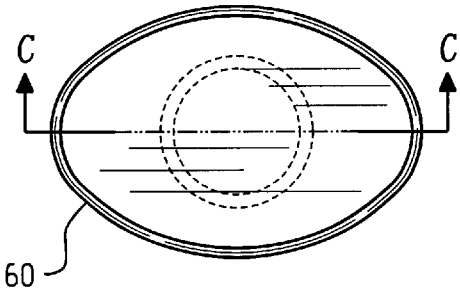
FIG. 7 is a top plan view of FIG. 5.
Figure 8:
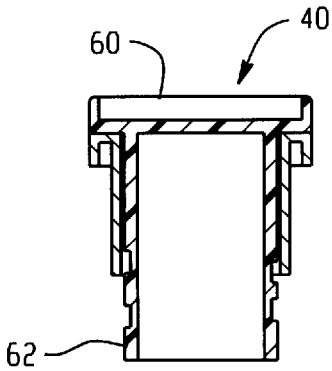
FIG. 8 is cross-sectional view taken generally along the lines A—A of FIG. 5.
Figure 9:
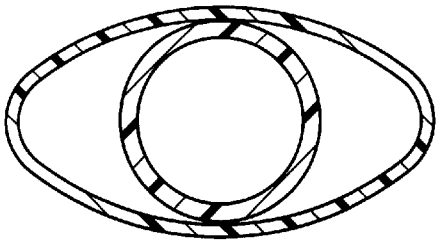
FIG. 9 is a cross-sectional view taken generally along the lines B—B of FIG. 5.
Figure 10:
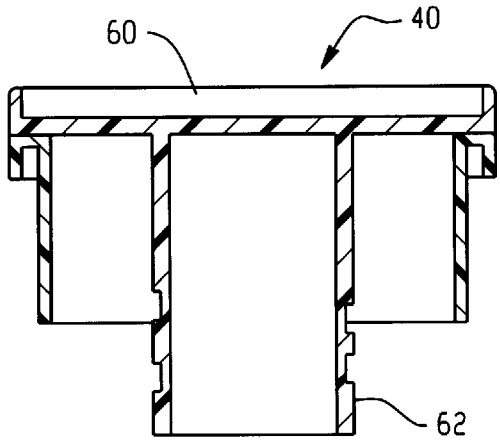
FIG. 10 is a cross-sectional view taken generally along the lines C—C of FIG. 7.

FIG. 2 illustrates the cap assembly 40 prior to assembly in the opening 28 of the container. As is apparent, the opening 28 has a generally oval shape with a pour lip 42 at one end and a vent region 44 at the other end generally as defined by a major axis of the generally oval/elliptical opening. More particular details of the function of the pour lip and vent regions will be described below. Preferably, a pair of dimples or projections 46 are provided in the opening to form a threaded mean s (here a male thread means) and cooperate with an external thread means (here a female thread means) such as threaded region 48 of the cap to allow the cap to be selectively threaded and unthreaded between open and closed positions. Curved sidewall portions 50, 52 are oppositely disposed in the container and form a partial cylindrical portion that receives the threaded neck 48 of the cap. They also preferably define the central region of the elliptical or oval shape of the opening, forming a partial symnmetrical surface of the overall opening. As will be appreciated upon review of the drawings, the curved sidewall portions 50, 52 are separated from one another generally along a minor axis of the generally oval/elliptical opening. The non-round elliptical or oval shape of the opening has a conformation with a first dimension in a first direction (between the pour lip 42 and the vent region 44) greater than a second dimension in a second direction (between the curved sidewall portions 50, 52).

The cap likewise has an oval or elliptical shape planar portion 60 that is integrally molded with a shank or cylindrical portion 62 that has the external threaded portion 48 thereon. The cylindrical portion 62 is preferably centered in a symnetrical fashion and extends outwardly or downwardly from a first or lower face of the oval portion 60. The thread 48 is integrally molded in an external surface of the cylindrical portion in a manner generally known in the art. As will be described further below, the helical projections or ridges 64 defining the threaded region 48 provide for a quarter (¼) turn relationship of the cap relative to the container opening. The helical threads are spaced or have a pitch that receives the projection or dimple (thread means) 46 of the container. The curved sidewall portions, and particularly the thread means 46, engage the cap threads 48 along only a portion of the circumference of the shank. The lower terminal portions of the threads on the cap may be generally linear, i.e., form a linear portion to allow the cap to be lifted upwardly once it has been rotated to an open position. However, it will be understood that it is not necessary to incorporate a lift or pullout feature in conjunction with the one quarter-turn opening.

With continued reference to FIGS. 1 and 2, and additional reference to FIGS. 3–10, more particular details of the structure and function of the cap are illustrated. For example, in FIG. 3, the cap is centered for insertion in the opening. The cap may be snapped on to the container during production. That is, by imposing an axial force on the cap as it is inserted into the container opening, the threads are received over the dimples and the cap secured in place. When pushed into place, the cap is preferably disposed in a closed position illustrated in FIGS. 4–10. A seal member 70 is integrally molded into the base of the cap to seal between the cap and container during shipment and handling. When in the closed position, the oval portion of the cap is coextensive with and matingly aligned over the oval opening of the container.

Figure 11:
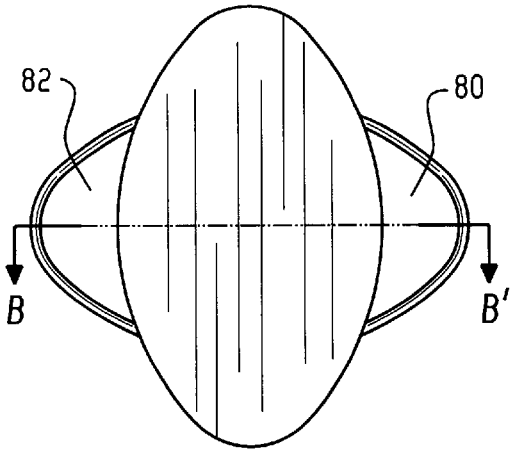
FIG. 11 is a top plan view of the assembled cap on the container opening in an open position.

The thread assembly provided by the dimple and the external threads on the cylindrical portion of the cap retain the cap in a tightly sealed condition relative to the container to prevent leakage. As noted above, the thread pitch in the preferred embodiment is such that a quarter-turn rotation of the cap relative to the container orients the cap ninety degrees relative to the opening so that a pour portion 80 and a vent portion 82 of the opening are defined on opposite sides of the cap (FIG. 11). As will be appreciated, the contents of the container can be poured through the pour portion 80 of the opening and air enters the container through the vent portion 82 during a pour. The cap need not be completely removed from the container; rather, the quarter-turn axially advances the cap outwardly from the container opening and through a ninety degree or quarter-turn relation to define the pour and vent portions. Once the pouring or dispensing is complete, the consumer can rotate the cap in the opposite direction to again seal the contents of the container from the external environment.

Figure 13:
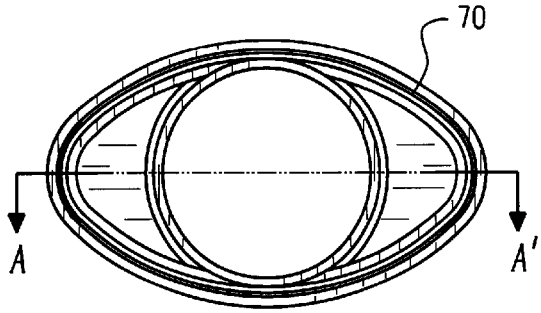
FIG. 13 is a bottom plan view of another exemplary embodiment of a cap.
Figure 12:
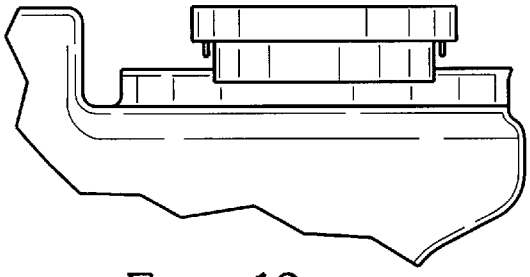
FIG. 12 is a view taken generally along the lines B–B' of FIG. 11.
Figure 14:
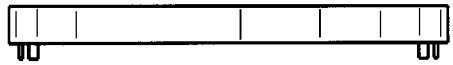
FIG. 14 is an elevational view of the cap of FIG. 13.

As illustrated in FIGS. 13 and 14, the invention should not be limited to the embodiment of FIGS. 1–12. It is also appreciated that the cap can adopt alternative configurations that achieve all or selected ones of the features noted above. For example, a thread assembly can be reversed in which a dimple is provided on a cylindrical portion of the cap and the helical thread provided in the internal sidewall defining the opening of the container. An external snap-fit lip may also be provided and extend about the lower periphery of the cap to define a snap fit with the continuous lip defining the opening in the container. This provides a positive, snap-fit relation in addition to the secure fit between the threaded portions of the lid and container. It is also conveniently and economically manufactured and enhances the seal that reduces the prospects for leaking during shipping.

Accordingly, a consumer pulls upwardly on the cap, and provides a quarter-turn to establish the pour and vent regions of the opening. The consumer need not remove the cap at all during the dispensing operation. When complete, the cap is then rotated a quarter-turn in the opposite direction and snapped on for storage.

The invention has been described with reference to the preferred embodiment. Obviously, modifications and alterations will occur to others upon a reading and understanding of this specification. For example, the cap assembly is not limited to use with the container shown in FIG. 1 and described in U.S. Pat. No. 6,068,161, and may be advantageously used with other containers used to dispense fluid products such as liquids, powders, granular materials, etc. Moreover, the particularly described assembly of the cap and container may be altered to encompass designs that achieve substantially the same functions and advantages as the present invention. The invention is intended to include all such modifications and alterations in so far as they come within the scope of the appended claims and the equivalents thereof.

Having thus described the invention, we claim:

1. A cap assembly for a container having a flowable product to be poured from the container, the cap assembly comprising:

a cap having a generally oval configuration and including an externally threaded shank having thread means;

an opening in the container having a generally oval configuration and thread means dimensioned to receive the cap thread means, said container opening sealingly receiving said cap in a first, closed position and defining a vent portion and a pour portion on opposite sides of the cap thread means when the cap is disposed in a second, open position.

2. The cap assembly of claim 1 wherein the vent portion and the pour portion are located at opposite ends of a major axis of the generally oval configuration.

3. The cap assembly of claim 2 wherein the opening thread means is located at opposite ends of the minor axis of the generally oval configuration.

4. The cap assembly of claim 1 wherein the opening thread means is located at opposite ends of a minor axis of the generally oval configuration.

5. The cap assembly of claim 1 wherein the cap thread means includes a cylindrical portion having external threads thereon.

6. The cap assembly of claim 5 wherein the cap thread means has a helical conformation.

7. The cap assembly of claim 1 further comprising a retainer for retaining the cap on the container.

8. A cap assembly for a container that selectively holds and dispenses a fluid product, the cap assembly comprising:

a rotatable cap having an oblong configuration and a shank extending outwardly therefrom, the shank having thread means received thereon;

an oblong opening in the container having thread means that cooperate with the shank thread means, the thread means of the opening engaging the shank thread means about only a portion of a shank periphery, wherein the thread means of the shank and opening permit the cap to rotate approximately one quarter-turn relative to the container opening to define a vent opening and a pour opening on opposite sides of the shank in an open position of the cap, and the oblong cap disposed in sealing, mating relation with the oblong opening in a closed position of the cap.

9. The cap assembly of claim 8 wherein the thread means of one of the shank and opening includes a retainer portion for securing the cap to the container.

10. The cap assembly of claim 8 wherein the thread means of the opening includes a projection that is received in a helical thread defining the thread means of the shank.

11. A reclosable comestible product container comprising:

an opening provided in the container through which the product is selectively poured, at least portions of a sidewall defining the opening having thread means, the opening having a conformation with a first dimension greater in a first direction than a second dimension in a second direction generally perpendicular thereto;

a cap dimensioned for operative engagement with the opening, the cap having having thread means that cooperate with the sidewall thread means, the cap having a conformation with a first dimension in a first direction greater than a second dimension in a second direction perpendicular thereto for selective mating sealing receipt with the opening, and defining a vent portion and a pour portion of the cap when the cap first dimension is generally aligned with the opening second dimension.

12. The container of claim 11 further comprising a retainer for maintaining the cap secured to the container.

13. The container of claim 8 wherein the thread means on the sidewall opening only engage a portion of the cap thread means.

14. A cap assembly for a container having a flowable product to be poured from the container, the cap assembly comprising:

a cap including a shank having external threads; and a non-round opening in the container having thread means providing a one-quarter turn between fully open and fully closed positions, the non-round opening dimensioned to operatively receive the cap, and defining a vent portion and a pour portion on opposite sides of the cap when the cap is disposed in an open position, and said container opening sealingly receiving said cap in a fully closed position.

15. The cap assembly of claim 14 wherein the thread means of the container opening are defined by first and second dimples.

16. A cap assembly for a container having a flowable product to be poured from the container, the cap assembly comprising:

a cap having a shank with external threads, said threads having a pitch providing for a ninety degree rotation between fully open and closed positions; and a container opening having a non-round configuration, and a sidewall defining the opening having first and second dimples dimensioned to receive the cap threads, the cap and container opening forming a vent portion and a pour portion on generally opposite sides of the cap when the cap is disposed in the fully open position, and the cap seating the container opening in the fully closed position.

17. The cap assembly of claim 16 wherein the container opening includes first and second curved sidewall portions from which the dimples extend.

18. The cap assembly of claim 16 wherein the shank has a cylindrical configuration extending outwardly from the cap.

19. The cap assembly of claim 16 wherein the shank extends into the container opening and the cap external threads cooperate with the dimples to retain the cap to the container during both open and closed positions.

20. The cap assembly of claim 16 further comprising first and second curved sidewall portions from which the dimples extend whereby the shank is engaged along only a portion of a circumference of the shank.

* * * * *